US010400317B2

(12) United States Patent
Todoroki et al.

(10) Patent No.: US 10,400,317 B2
(45) Date of Patent: Sep. 3, 2019

(54) FE—CR—NI—MO ALLOY AND METHOD FOR PRODUCING THE SAME

(71) Applicant: Nippon Yakin Kogyo Co., Ltd., Tokyo (JP)

(72) Inventors: Hidekazu Todoroki, Yokohama (JP); Fumiaki Kirihara, Kawasaki (JP)

(73) Assignee: NIPPON YAKIN KOGYO CO., LTD., Tokyo (JP)

( * ) Notice: Subject to any disclaimer, the term of this patent is extended or adjusted under 35 U.S.C. 154(b) by 458 days.

(21) Appl. No.: 15/246,126

(22) Filed: Aug. 24, 2016

(65) Prior Publication Data

US 2017/0058384 A1 Mar. 2, 2017

(30) Foreign Application Priority Data

Aug. 28, 2015 (JP) ..... 2015-169380

(51) Int. Cl.

| | |
|---|---|
| ***C22C 38/00*** | (2006.01) |
| ***C22C 38/42*** | (2006.01) |
| ***C22C 38/44*** | (2006.01) |
| ***C22C 38/50*** | (2006.01) |
| ***C22C 38/04*** | (2006.01) |
| ***C22C 33/04*** | (2006.01) |
| ***C22C 38/52*** | (2006.01) |
| ***C22C 38/06*** | (2006.01) |
| ***C22C 38/02*** | (2006.01) |
| ***C22C 33/00*** | (2006.01) |

(52) U.S. Cl.

CPC ..... *C22C 38/52* (2013.01); *C22C 33/006* (2013.01); *C22C 33/04* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/50* (2013.01)

(58) Field of Classification Search

CPC ... C22C 38/001; C22C 38/002; C22C 38/004; C22C 38/02; C22C 38/04; C22C 38/06; C22C 38/42; C22C 38/44; C22C 38/50; C22C 38/52; C22C 33/006; C22C 33/04

USPC ..... 420/38, 582

See application file for complete search history.

(56) References Cited

U.S. PATENT DOCUMENTS

| | | | |
|---|---|---|---|
| 4,742,324 | A | 5/1988 | Shida et al. |
| 4,808,371 | A | 2/1989 | Taniuchi et al. |
| 6,459,195 | B1 | 10/2002 | Ono |
| 2015/0376752 | A1 | 12/2015 | Yamakawa et al. |

FOREIGN PATENT DOCUMENTS

| | | | | |
|---|---|---|---|---|
| CN | 1289857 | A | | 4/2001 |
| JP | S63-121641 | A | | 5/1988 |
| JP | S64-8695 | B2 | | 2/1989 |
| JP | S64-11106 | B2 | | 2/1989 |
| JP | 2003-147492 | A | | 5/2003 |
| JP | 2004149830 | A | * | 5/2004 |
| JP | 2013-241650 | A | | 12/2013 |
| JP | 2014-084493 | A | | 5/2014 |
| JP | 2014-105341 | A | | 6/2014 |
| JP | 2014-189826 | A | | 10/2014 |

OTHER PUBLICATIONS

Machine translation of JP2014-105341, Jun. 9, 2014, 17 pages. (Year: 2014).*

Machine translation of JP2014-189826, Oct. 6, 2014, 16 pages. (Year: 2014).*

Machine translation of JP2004-149830, 2004, 12 pages. (Year: 2004).*

Hino, Mitsutaka et al., "Thermodynamic Data for Steelmaking", The 19th Committee on Steelmaking, The Japan Society for Promotion of Science, Tohoku University Press, Sendai, 2010.

Nov. 29, 2018 Office Action issued in Chinese Patent Application No. 201610729653.2.

* cited by examiner

*Primary Examiner* — Matthew E. Hoban
*Assistant Examiner* — Lynne Edmondson
(74) *Attorney, Agent, or Firm* — Oliff PLC

(57) ABSTRACT

Fe—Cr—Ni—Mo alloy having superior surface properties and a method for producing the same using a commonly used apparatus at low cost. The Fe—Cr—Ni—Mo alloy has (% indicates mass %): C: ≤0.03%, Si: 0.15 to 0.5%, Mn: 0.1 to 1%, P: ≤0.03%, S: ≤0.002%, Ni: 20 to 32%, Cr: 20 to 26%, Mo: 0.5 to 2.5%, Al: 0.1 to 0.5%, Ti: 0.1 to 0.5%, Mg: 0.0002 to 0.01%, Ca: 0.0002 to 0.01%, N: ≤0.02%, O: 0.0001 to 0.01%, freely contained components of Co: 0.05 to 2% and Cu: 0.01 to 0.5%, Fe as a remainder, and inevitable impurities, wherein MgO, $MgO.Al_2O_3$ spinel type, and $CaO—Al_2O_3—MgO$ type are contained as oxide type non-metallic inclusions, ratio of number of $MgO.Al_2O_3$ spinel type to all oxide type non-metallic inclusions is ≤50%, and $CaO—Al_2O_3—MgO$ type contains CaO: 30 to 70%, $Al_2O_3$: 5 to 60%, MgO: 1 to 30%, $SiO_2$: ≤8%, and $TiO_2$: ≤10%.

19 Claims, No Drawings

FE—CR—NI—MO ALLOY AND METHOD FOR PRODUCING THE SAME

TECHNICAL FIELD

The present invention relates to an Fe—Cr—Ni—Mo alloy having superior surface quality. The Fe—Cr—Ni—Mo alloy of the present invention has superior high-temperature corrosion resistance in an atmosphere at high temperature, corrosion resistance in a wet environment such as in water, and blackening treatment characteristics, and is appropriate for using as a sheath tube of a so-called sheathed heater.

BACKGROUND ART

A sheathed heater in which nichrome wire is employed has been widely used as a heat source in electric cookers, electric water heaters and the like. This sheathed heater performs heating by inserting nichrome wire into a metallic sheath tube, filling magnesia powder or the like into a space in the tube, sealing tightly, and supplying electric current through the nichrome wire. This heating method is very safe since no flame is used, and has been widely employed in electric cookers such as fish baking grills, electric water heaters and the like as a necessary item for a so-called all-electric home. The demand for this has become very widespread (See Japanese Examined Patent Application Publication No. Sho64 (1989)-008695, No. Sho64 (1989)-011106, Japanese Unexamined Patent Application Publication No. Sho63 (1988)-121641, No. 2013-241650, and No. 2014-84493).

However, Fe—Cr—Ni—Mo alloy containing Ti and Al which is a necessary component for a sheathed heater has a problem in that surface defects may occur since Ti and Al would cause generation of TiN or alumina inclusions. To solve this problem, a technique is disclosed in which Si concentration is decreased so as to control generation of TiN. However, there is another risk of the occurrence of defects by non-metal inclusions of oxide composition (See Japanese Unexamined Patent Application Publication No. 2003-147492).

Furthermore, a technique to produce Fe—Cr—Ni alloy having superior surface property is disclosed. This technique reduces $MgO.Al_2O_3$ (spinel type) and CaO inclusions so as to prevent surface defects. This technique controls the inclusions as $CaO—TiO_2—Al_2O_3$ type inclusions; however, inclusions mainly containing $TiO_2$ may be generated depending on condition of operation, and there may be defects generated. In particular, since the sheathed heater material requires strict surface quality, the technique cannot be employed (See Japanese Unexamined Patent Application Publication No. 2014-189826).

SUMMARY OF INVENTION

As explained above, by conventional techniques, it is difficult to produce a sheathed heater while restraining generation of surface defects in the sheathed heater material. That is, it is difficult to prevent TiN, alumina type inclusions, $MgO.Al_2O_3$ (spinel) inclusions and CaO inclusions. An object of the present invention is to provide Fe—Cr—Ni—Mo alloy having superior surface property, and to provide a method for producing the same using a common apparatus at low cost.

The inventors have researched to solve the above matters. First, surface defects are collected and compositions of inclusions that actually cause defects are analyzed. As a result, it became clear that defects are caused by TiN inclusions, $Al_2O_3$ inclusions, $MgO.Al_2O_3$ spinel inclusions, CaO inclusions, and $CaO—Al_2O_3—TiO_2$ inclusions. As a result of further research, these oxides are found to be non-metallic inclusions contained in molten alloy and adhere to the inner wall of a submerged nozzle which carries molten metal from a tundish of a continuous casting apparatus to a mold. It became clear that a large defect may be generated when part of the adhered material falls off. In addition, MgO or $CaO—Al_2O_3—MgO$ type is appropriate as non-metallic inclusions.

Furthermore, the inventors have considered the refining characteristics of the Fe—Cr—Ni—Mo alloy. Before controlling the non-metallic inclusions, first, it is necessary to effectively reduce oxygen concentration. The inventors have researched deoxidizing ability. Deoxidizing experiments were performed in the laboratory. Various types of alloy compositions were put in a magnesia crucible and melted in an upright resistance furnace. Si, Mn, Al, Ca, Mg, Ti were put therein. Slag was added to perform deoxidizing experiments. It became clear that deoxidizing reaction is promoted by the following two elements.

$$\underline{Si}+2\underline{O}=(SiO_2) \quad (1)$$

$$2\underline{Al}+3\underline{O}=(Al_2O_3) \quad (2)$$

The underlined part is the composition in the molten steel, and the part in parentheses is the composition in the slag. First, inclusions which must be avoided are made of TiN. Even if Ti is controlled within 0.1 to 0.5% and N is controlled within 0.005 to 0.02%, it became clear that high Si concentration causes high activity coefficient of Ti ($e_{Ti}^{Si}$=1.43), and generation of TiN. Therefore, Si must be controlled to be 0.5% or less. Thus, it became clear that insufficient deoxidation power can be compensated by Mo. That is, Mo has an effect of increasing activity coefficient of Si ($e_{Si}^{Mo}$=2.36), and therefore Mo should be added efficiently. In this way, it became clear that Mo, which is also effective for corrosion resistance, should be added at 0.5% or more. Furthermore, it became clear that the non-metallic inclusions can be of the MgO or $CaO—Al_2O_3—MgO$ type by controlling Al: 0.1 to 0.5%, Mg: 0.0002 to 0.01%, Ca: 0.0002 to 0.01%, O: 0.0001 to 0.01% (See Thermodynamic Data For Steelmaking: Edited by M. Hino and K. Ito, The 19th Committee in Steelmaking, The Japan Society for Promotion of Science, Tohoku University Press, Sendai, (2010). ISBN978-4-86163-129-0 C3057).

The present invention is completed in view of the above; that is, the present invention is an Fe—Cr—Ni—Mo alloy having (hereinafter % indicates mass %): C: 0.03% or less, Si: 0.15 to 0.5%, Mn: 0.1 to 1%, P: 0.03% or less, S: 0.002% or less, Ni: 20 to 32%, Cr: 20 to 26%, Mo: 0.5 to 2.5%, Al: 0.1 to 0.5%, Ti: 0.1 to 0.5%, Mg: 0.0002 to 0.01%, Ca: 0.0002 to 0.01%, N: 0.02% or less, O: 0.0001 to 0.01%, freely contained components of Co: 0.05 to 2% and Cu: 0.01 to 0.5%, Fe as a remainder, and inevitable impurities, wherein MgO, $MgO.Al_2O_3$ spinel type, and $CaO—Al_2O_3—MgO$ type are contained as oxide type non-metallic inclusions, ratio of number of the $MgO.Al_2O_3$ spinel type to all oxide type non-metallic inclusions is 50% or less, and the $CaO—Al_2O_3—MgO$ type comprises CaO: 30 to 70%, $Al_2O_3$: 5 to 60%, MgO: 1 to 30%, $SiO_2$: 8% or less, and $TiO_2$: 10% or less.

In the Fe—Cr—Ni—Mo alloy of the present invention, it is desirable that as oxide type non-metallic inclusions, the composition range of the $MgO.Al_2O_3$ spinel type is MgO: 15 to 35% and $Al_2O_3$: 65 to 85%.

In the Fe—Cr—Ni—Mo alloy of the present invention, it is desirable that the number of oxide type non-metallic inclusions of 5 μm or more be 50/cm$^2$ or less and the number of oxide type non-metallic inclusions of 100 μm or more be 5/cm$^2$ or less, and it is more desirable that the number of oxide type non-metallic inclusions of 5 μm or more be 48/cm$^2$ or less and the number of oxide type non-metallic inclusions of 100 μm or more be 3/cm$^2$ or less, in the case in which the number of the inclusions is measured at freely selected cross section of a sample collected in a tundish of a continuous casting apparatus.

In the Fe—Cr—Ni—Mo alloy of the present invention, it is desirable that $SiO_2$ and $TiO_2$ contained in the CaO—$Al_2O_3$—MgO type as oxide type non-metallic inclusions be 2 mass % or less and 6 mass % or less, respectively, and it is more desirable that no $SiO_2$ and $TiO_2$ be contained.

In addition, the method for production of the alloy is also provided. That is, the method for production of the Fe—Cr—Ni—Mo alloy of the present invention includes steps of: melting raw materials so as to melt Fe—Cr—Ni—Mo alloy containing Ni: 20 to 32%, Cr: 20 to 26%, Mo: 0.5 to 2.5%, decarburizing in AOD and/or VOD, adding lime, fluorite, ferrosilicon alloy, and Al so as to form CaO—$SiO_2$—$Al_2O_3$—MgO—F type slag having CaO/$SiO_2$ 1.5 to less than 4, and preparing Fe—Cr—Ni—Mo melt alloy comprising C: 0.03% or less, Si: 0.15 to 0.5%, Mn: 0.1 to 1%, P: 0.03% or less, S: 0.002% or less, Al: 0.1 to 0.5%, Ti: 0.1 to 0.5%, Mg: 0.0002 to 0.01%, Ca: 0.0002 to 0.01%, N: 0.02% or less, O: 0.0001 to 0.01%, a freely contained components of Co: 0.05 to 2% and Cu: 0.01 to 0.5%, Fe as a remainder, and inevitable impurities.

According to the present invention, by adjusting alloy components, TiN can be prevented from being generated, and oxide type non-metallic inclusions composition can be controlled to be within an appropriate composition. As a result, a high quality in which there is no surface defects can be realized in thin-plate products. Therefore, raw material for the sheathed heater which is used in electric cookers and electric water heaters can be provided at high yield and low cost.

EMBODIMENT OF INVENTION

First, a reason for limiting chemical composition of the Fe—Cr—Ni—Mo alloy of the present invention is explained. Hereinafter, "%" means "mass %".

C: 0.03% or less

C is an element for stabilizing an austenite phase. In addition, since it also has an effect of increasing alloy strength by a solid solution strengthening, it is a necessary element to maintain strength at ordinary temperature and high temperature. On the other hand, C is also an element that forms carbide with Cr having a large effect of improving corrosion resistance and therefore forms a Cr-absent layer therearound, so that corrosion resistance is decreased. Therefore, it is necessary that the upper limit of addition be 0.03%, desirably be 0.005 to 0.025%, and more desirably be 0.005 to 0.023%.

Si: 0.15 to 0.5%

Si is an important element in the present invention. It has an effect of controlling oxygen concentration within 0.0001 to 0.01% by contributing to deoxidizing. In addition, it also has an effect of controlling Mg concentration and Ca concentration in the alloy within 0.0002 to 0.01% and 0.0002 to 0.01%, respectively. This is caused by the following reactions.

$$2(MgO)+\underline{Si}=2\underline{Mg}+(SiO_2) \quad (3)$$

$$2(CaO)+\underline{Si}=2\underline{Ca}+(SiO_2) \quad (4)$$

In the case in which Si concentration is less than 0.15%, not only may oxygen concentration be increased more than 0.01%, but also concentrations of Mg and Ca may be decreased less than 0.0002%. On the other hand, in the case in which Si concentration is more than 0.5%, concentrations of Mg and Ca may be increased more than 0.01%. In addition, Si contributes to preventing TiN from being generated. That is, even in the case in which Ti is controlled to be 0.1 to 0.5% and N is controlled to be 0.02% or less, activity coefficient of Ti may be increased and TiN may be generated if Si concentration is high. Therefore, Si concentration is limited to be within 0.15 to 0.5%, desirably be 0.16 to 0.48%, more desirably be 0.17 to 0.45%. It is further more desirably 0.18 to 0.35%.

Mn: 0.1 to 1%

Mn is an element for stabilizing an austenite phase, and it is necessary to add 0.1%. However, the upper limit is 1% since oxidation resistance is deteriorated by adding a large amount. It is desirably in a range of 0.2 to 0.6% and more desirably in a range of 0.22 to 0.57%.

P: 0.03% or less

P is an undesirable element that segregates at grain boundaries and generates cracking during hot processing. Therefore, it is desirable to reduce it as much as possible to 0.030% or less. It is desirably 0.025% or less, and more desirably 0.022% or less.

S: 0.002% or less

S is an undesirable element which segregates at grain boundaries, forms low melting point compounds and generates hot cracking during production process. Therefore, it is desirable to reduce it as much possible to 0.002% or less. It is desirably 0.001% or less, and more desirably 0.0008% or less.

Ni: 20 to 32%

Ni is an element for stabilizing an austenite phase, and it is contained at 20% or more from the viewpoint of structural stability. In addition, it has an effect of improving heat resistance and strength at high temperature. However, adding an excess amount may cause increasing raw material cost, and the upper limit is 32%. It is desirably in a range of 20.5 to 30%, more desirably 21 to 29%, and further more desirably 22 to 28%.

Cr: 20 to 26%

Cr is an effective element to improve corrosion resistance in wet environments. In addition, it has an effect in which deterioration of corrosion resistance by an oxide layer formed by a heat treatment in which atmosphere and dew-point are not controlled like in an intermediate heat treatment, is restrained. In addition, it also has an effect restraining corrosion in high temperature air. In order to maintain stably the effect of improving corrosion resistance in wet environments and high temperature air environments mentioned above, it is necessary to add 20% or more. However, an excess amount of addition of Cr may cause deterioration of stability of an austenite phase, and therefore requires large amount of Ni, and the upper limit of Cr is 26%. Therefore, the amount of addition is limited in a range of 20 to 26%. It is desirably in a range of 20.3 to 25.3%, more desirably 21 to 25%, and further more desirably 21.2 to 24%.

Mo: 0.5 to 2.5%

Mo has an effect of significantly improving corrosion resistance in wet environments with chloride and high temperature air environments even by a small amount of addition, and the corrosion resistance is improved in proportion to the amount of addition. Furthermore, the upper limit of Si which is effective for deoxidizing is 0.5%, and insufficient deoxidizing force is compensated by Mo. That is, Mo has an effect to increase activity coefficient of Si, and it is a useful element. Therefore, it is necessary to add at least 0.5%. On the other hand, with respect to corrosion resistance after an oxide layer is formed during intermediate heat treatment, Mo has an effect of improving to some extent; however, addition of too much is not effective. Furthermore, in a material in which a large amount of Mo is added in the case in which oxygen potential of the surface is low in a high temperature air environment, Mo may be preferentially oxidized and an oxide layer may be separated, which is undesirable. From the above viewpoint, Mo is limited in a range of 0.5 to 2.5%. It is desirably in a range of 0.58 to 2.45%, more desirably 0.6 to 2.2%, and further more desirably 0.63 to 1.7%.

C: 0.05 to 2%

Since Co is an effective element to stabilize an austenite phase, it can be added at 0.05% or more as a freely contained component. However, since an excess amount of addition may cause increasing raw material cost, it is limited 2.0% or less. It is desirably in a range of 0.05 to 1.5%, more desirably 0.05 to 1.2%.

Cu: 0.01 to 0.5%

Since Cu is an effective element to improve sulfuric acid corrosion resistance, it can be added at 0.01% or more as a freely contained component. It is desirably in a range of 0.02 to 0.48%, more desirably 0.03 to 0.46%.

Al: 0.1 to 0.5%

Al is an element necessary for property required as a sheathed heater. That is, it is an effective element to form a dense black layer having high emissivity, and it is necessary at at least 0.1%. Furthermore, it is an important element for deoxidizing, and it has an effect to control oxygen concentration in a range of 0.0001 to 0.01%. In addition, it also has an effect to control Mg concentration in a range of 0.0002 to 0.01% and Ca concentration in a range of 0.0002 to 0.01% in an alloy. This is realized by the following reactions.

$$3(MgO)+2\underline{Al}=3\underline{Mg}+(Al_2O_3) \quad (5)$$

$$3(CaO)+2\underline{Al}=3\underline{Ca}+(Al_2O_3) \quad (6)$$

In the case in which Al concentration is less than 0.1%, not only may oxygen concentration be increased more than 0.01%, but also Mg and Ca concentration may be decreased to be less than 0.0002%. On the other hand, in the case in which Al concentration is more than 0.5%, Mg and Ca concentration may be increased more than 0.01%. Therefore, it is limited in a range of 0.1 to 0.5%. It is desirably in a range of 0.12 to 0.48%, more desirably 0.15 to 0.46%, and further more desirably 0.16 to 0.45%.

Ti: 0.1 to 0.5%

Ti is an element necessary for properties required for a sheathed heater. That is, it is an effective element to form a dense black layer having high emissivity, and it is necessary at at least 0.1%. However, amount of addition of more than 0.5% may cause formation of TiN and generating surface defects. TiN is undesirable since it forms inclusions that adhere on inner walls of submerged nozzles. In the case in which inclusions adhere inside of a submerged nozzle, the adhered deposited material may fall off, be carried to a mold together with molten alloy, be trapped in a solidified shell, and cause surface defects. Therefore, it is limited in a range of 0.1 to 0.5%. It is desirably in a range of 0.15 to 0.45%, more desirably 0.16 to 0.4%, and further more desirably 0.17 to 0.38%.

Mg: 0.0002 to 0.01%

Mg is an element necessary to control inclusion composition into MgO and CaO—$Al_2O_3$—MgO type. Therefore, it is necessary to add 0.0002% or more. An excess amount of addition of Mg may cause generation of bubbles due to Mg gas during solidification. Therefore, it is limited in a ranged of 0.0002 to 0.01%. It is desirable that Mg be added from the slag composition to molten alloy while Mg being effectively reduced, as mentioned above. It is desirably in a range of 0.0003 to 0.008%, more desirably 0.0004 to 0.0075%, and further more desirably 0.0005 to 0.005%.

Ca: 0.0002 to 0.01%

Ca is an element necessary to control inclusion composition into CaO—$Al_2O_3$—MgO type. Therefore, it is necessary to add 0.0002% or more. An excess amount of addition of Ca may cause forming CaO inclusions and therefore generating surface defects. Therefore, it is limited in a range of 0.0002 to 0.01%. It is desirable that Ca be added from the slag composition to molten alloy while Ca being effectively reduced as mentioned above. It is desirably in a range of 0.0003 to 0.008%, more desirably 0.0004 to 0.006%, and further more desirably 0.0005 to 0.005%.

N: 0.02% or less

N is an undesirable element since it forms TiN and generates surface damage. TiN is undesirable since it forms inclusions that adhere on inner walls of submerged nozzles. In the case in which inclusions adhere inside a submerged nozzle, the adhered deposited material may fall off, be carried to a mold together with molten alloy, be trapped in solidified shell, and cause surface defects. Furthermore, formation of TiN adversely affects so that effect of solute Ti is reduced. Therefore, it is limited to 0.02% or less. It is desirably 0.018% or less, more desirably 0.017% or less, and further more desirably 0.015% or less.

O: 0.0001 to 0.01%

Oxygen concentration is important since it is closely associated with inclusions. In the case in which 0 exists at more than 0.01% in an alloy, desulfurizing is inhibited and the number of inclusions is increased. When the number of inclusions at a freely selected cross section of sample collected in a tundish of a continuous casting apparatus is measured, the number of inclusions having a size of 5 μm or more reaches more than 50/cm$^2$ and the number of inclusions having size of 100 μm or more reaches more than 5/cm$^2$, thereby generating defects. However, in the case in which oxygen concentration is too low, Ca and Mg concentration may be over the upper limit of 0.01%. Therefore, O concentration is limited in a range of 0.0001 to 0.01%. It is desirably in a range of 0.0002 to 0.008%, more desirably 0.0003 to 0.006%, and further more desirably 0.0004 to 0.005%. Oxide type non-metallic inclusions: MgO, CaO—$Al_2O_3$—MgO type MgO, CaO—$Al_2O_3$—MgO type inclusions are harmless inclusions which do not adhere on inner wall of a submerged nozzle which carries molten metal from a tundish of a continuous casting apparatus to a mold. They do not generate surface defects since they do not adhere. Therefore, the present invention includes MgO and CaO—$Al_2O_3$—MgO type. In order to control inclusion into this composition, each concentration of Al, Si, Mg and Ca is controlled within the component range defined in the present invention. Oxide type non-metallic inclusions: $MgO.Al_2O_3$ spinel type (50% or less in number ratio)

$MgO.Al_2O_3$ spinel is an inclusion that adheres on an inner wall of a submerged nozzle. In the case in which inclusions adhere inside a submerged nozzle, the adhered deposited material may fall off, be carried to a mold together with molten alloy, be trapped in solidified shell, and cause surface defects. However, in the case in which it is less than 50% in number ratio, the tendency to adhere is low. Therefore, $MgO.Al_2O_3$ spinel is allowable as long as the number ratio is 50% or less. It should be noted that the composition range of spinel is MgO: 15 to 35%, $Al_2O_3$: 65 to 85%. Furthermore, the number ratio is desirably 45% or less, more desirably 40% or less, and further more desirably 35% or less.

$CaO—Al_2O_3—MgO$ type inclusion: CaO: 30 to 70%, $Al_2O_3$: 5 to 60%, MgO: 1 to 30%, $SiO_2$: 8% or less, $TiO_2$: 10% or less It is more desirable that the molten condition be maintained in the case in which the composition range of CaO, $Al_2O_3$ and MgO among $CaO—Al_2O_3—MgO$ type inclusions be within the above ranges. In the case in which the composition is out of the ranges, the compound may behave as a solid, and there is a tendency to adhere to the nozzle. In the case in which inclusions adhere inside of a submerged nozzle, the adhered deposited material may fall off, be carried to a mold together with molten alloy, be trapped in a solidified shell, and cause surface defects. Furthermore, in the case in which $SiO_2$ and $TiO_2$ exceed the above ranges, inclusions in metal are aggregated and coarsened. Therefore, it is limited so that CaO: 30 to 70%, $Al_2O_3$: 5 to 60%, MgO: 1 to 30%, $SiO_2$: 8% or less, $TiO_2$: 10% or less. It is desirably in a range of CaO: 31 to 64.3%, $Al_2O_3$: 8 to 56%, MgO: 2.5 to 27.6%, $SiO_2$: 7% or less, $TiO_2$: 8% or less, more desirably CaO: 32 to 60%, $Al_2O_3$: 10 to 56%, MgO: 8 to 25%, $SiO_2$: 6.7% or less, $TiO_2$: 6% or less.

Number of Oxide Type Inclusions:

When the number of oxide type inclusions at a freely selected cross section of sample collected in a tundish of a continuous casting apparatus is measured, it is desirable that the number of inclusions having a size of 5 μm or more be 50/cm$^2$ or less and the number of inclusions having a size of 100 μm or more be 5/cm$^2$ or less. The reason is that in the case in which the number of oxide type inclusions is over the range, coarsened large inclusions are increased, thereby generating surface defects of the product. It is desirable that the number of inclusions having a size of 5 μm or more be 48/cm$^2$ or less and the number of inclusions having a size of 100 μm or more be 3/cm$^2$ or less, and more desirable that the number of inclusions having a size of 5 μm or more be 45/cm$^2$ or less and the number of inclusions having a size of 100 μm or more be 2/cm$^2$ or less.

In the present invention, the method for production of the alloy is also given hereinafter. Raw material such as stainless steel scrap, iron scrap, ferrochromium and ferronickel are melted so as to prepare Fe—Cr—Ni—Mo alloy containing Ni: 20 to 32%, Cr: 20 to 26%, Mo: 0.5 to 2.5%. It is desirable to use an electric furnace. Next, oxygen is blown in AOD (Argon Oxygen Decarburization) and/or VOD (Vacuum Oxygen Decarburization) so as to decarburize. Lime, fluorite, ferrosilicon alloy and Al are added so as to form $CaO—SiO_2—Al_2O_3—MgO—F$ type slag having $CaO/SiO_2$ (slag basicity: C/S) in a range of 1.5 to less than 4. Magnesia brick scrap and light-burned dolomite are desirable as MgO sources, and bricks of a refining furnace can be of the MgO type so as to dissolve into slag. Here, it is desirable that composition range of $CaO—SiO_2—Al_2O_3—MgO—F$ type slag be CaO: 40 to 63%, $SiO_2$: 15 to 25%, $Al_2O_3$: 6 to 14%, MgO: 6 to 18%, F: 4 to 10%.

Subsequently, Al and Ti are added to deoxidize, and O concentration is controlled in a range of 0.0001 to 0.01%. Furthermore, MgO and CaO in the slag is effectively reduced, and finally, composition is controlled as follows: Al: 0.1 to 0.5%, Ti: 0.1 to 0.5%, Mg: 0.0002 to 0.01%, Ca: 0.0002 to 0.01%. Furthermore, by blowing Ar gas, N is adjusted 0.02% or less.

The reason for controlling slag basicity C/S to be within 1.5 to less than 4 is to control the inclusion compositions to the composition defined in the present invention. In the case in which it is less than 1.5, the number of inclusions may be more than 100/cm$^2$, and the inclusions may mainly contain alumina, which easily adheres on inner walls of nozzles. On the other hand, in the case in which it is 4 or more, CaO, $CaO—Al_2O_3—TiO_2$ type inclusions may be formed and surface defects may be generated. Therefore, it is limited to a range of 1.5 to less than 4. It is desirably in a range of 1.6 to 3.9, and more desirably 1.9 to 3.6. The number of inclusions is desirably 100/cm$^2$ or less, more desirably 50/cm$^2$ or less, and further more desirably 45/cm$^2$ or less.

EXAMPLES

The effect of the present invention is explained by way of Examples. First, raw materials such as stainless steel scrap, iron scrap, nickel, ferronickel, and molybdenum were melted in a 60 t electric furnace. Then, oxygen was blown (oxidizing refining) in order to remove C in AOD and/or VOD so as to decarburize. Cr reduction was performed. After that, lime, fluorite, light-burned dolomite, ferrosilicon alloy and Al were added, and deoxidized by forming $CaO—SiO_2—Al_2O_3—MgO—F$ type slag. Subsequently, Ar stirring was performed to promote desulfurizing. It should be noted that magnesia-chrome brick lining was performed in AOD and VOD. Next, the chemical composition was adjusted in ladle refining, and slabs were produced by the continuous casting apparatus.

The surface of a slab produced was ground, heated at 1200° C., and hot rolled so as to produce a hot strip having a thickness of 6 mm. Then, the strip was annealed and acid-washed so as to remove scale on the surface. Finally, cold rolling was performed so as to obtain a cold rolled coil having a thickness 1 mm, width 1 m, and length 1000 m. Table 1 shows chemical composition of alloy and slag composition in Examples and Comparative Example, and Table 2 shows results of analysis of inclusions in the alloy. It should be noted that value in brackets "[ ]" means it is out of the range of the present invention.

TABLE 1

| | | Chemical composition (remainder Fe) mass % | | | | | | | | | | | |
|---|---|---|---|---|---|---|---|---|---|---|---|---|---|
| | No. | C | Si | Mn | P | S | Ni | Cr | Mo | Cu | Co | Al | Ti |
| Examples | 1 | 0.021 | 0.21 | 0.65 | 0.015 | 0.0001 | 21.2 | 21.2 | 0.85 | — | — | 0.45 | 0.28 |
| | 2 | 0.028 | 0.16 | 0.25 | 0.012 | 0.0012 | 28.4 | 25.3 | 2.45 | 0.02 | 0.42 | 0.35 | 0.18 |
| | 3 | 0.015 | 0.34 | 0.45 | 0.019 | 0.0002 | 25.1 | 23.6 | 1.21 | 0.05 | — | 0.27 | 0.36 |
| | 4 | 0.008 | 0.35 | 0.15 | 0.012 | 0.0015 | 20.5 | 20.3 | 0.63 | — | 0.84 | 0.33 | 0.25 |
| | 5 | 0.017 | 0.48 | 0.95 | 0.025 | 0.0008 | 31.5 | 22.3 | 0.58 | — | 1.51 | 0.16 | 0.24 |
| | 6 | 0.025 | 0.24 | 0.53 | 0.025 | 0.0008 | 26.3 | 23.7 | 0.68 | 0.35 | 1.23 | 0.17 | 0.17 |

TABLE 1-continued

| | | | | | | | | | | | | | |
|---|---|---|---|---|---|---|---|---|---|---|---|---|---|
| | 7 | 0.025 | 0.18 | 0.57 | 0.021 | 0.0018 | 26.3 | 23.7 | 0.65 | 0.15 | — | 0.16 | 0.23 |
| | 8 | 0.025 | 0.25 | 0.57 | 0.018 | 0.0005 | 24.5 | 23.7 | 0.65 | — | 0.51 | 0.16 | 0.23 |
| Comparative | 9 | 0.015 | [0.68] | 0.45 | 0.019 | 0.0002 | 25.1 | 23.6 | 0.98 | — | — | 0.27 | 0.45 |
| Examples | 10 | 0.028 | [0.05] | 0.25 | 0.012 | 0.0012 | 28.4 | 25.3 | [0.25] | 0.45 | 0.42 | [0.08] | [0.05] |
| | 11 | 0.021 | [0.71] | 0.65 | 0.015 | 0.0001 | 21.2 | 21.2 | 0.85 | 0.48 | — | [0.85] | [0.65] |
| | 12 | 0.025 | [0.05] | 0.57 | 0.021 | 0.0018 | 26.3 | 23.7 | 0.65 | — | 0.51 | [0.05] | 0.23 |
| | 13 | 0.021 | [1.52] | [1.23] | 0.015 | 0.0001 | 21.2 | 21.2 | 0.85 | — | — | [1.85] | 0.47 |

| | | Chemical composition (remainder Fe) mass % | | | | Slag composition mass % | | | | | |
|---|---|---|---|---|---|---|---|---|---|---|---|
| | No. | Mg | Ca | N | O | CaO | $SiO_2$ | $Al_2O_3$ | MgO | F | C/S |
| Examples | 1 | 0.0075 | 0.0052 | 0.013 | 0.0002 | 62.3 | 15.9 | 7.5 | 6.8 | 7.5 | 3.9 |
| | 2 | 0.0023 | 0.0012 | 0.015 | 0.0021 | 48.3 | 20.5 | 13.5 | 13.2 | 4.5 | 2.4 |
| | 3 | 0.0045 | 0.0005 | 0.009 | 0.0005 | 55.2 | 21.3 | 7.2 | 12.3 | 4.0 | 2.6 |
| | 4 | 0.0035 | 0.0025 | 0.009 | 0.0014 | 53.2 | 21.3 | 6.5 | 12.3 | 6.7 | 2.5 |
| | 5 | 0.0015 | 0.0003 | 0.013 | 0.0051 | 44.3 | 23.5 | 10.3 | 14.5 | 7.4 | 1.9 |
| | 6 | 0.0005 | 0.0002 | 0.008 | 0.0075 | 40.1 | 23.5 | 9.5 | 17.9 | 9.0 | 1.7 |
| | 7 | 0.0004 | 0.0003 | 0.012 | 0.0052 | 42.8 | 22.8 | 10.5 | 17.9 | 6.0 | 1.9 |
| | 8 | 0.0004 | 0.0003 | 0.011 | 0.0012 | 42.8 | 22.8 | 10.5 | 17.9 | 6.0 | 1.9 |
| Comparative | 9 | 0.0045 | 0.0005 | [0.025] | 0.0005 | 55.2 | 21.3 | 7.2 | 12.3 | 4.0 | 2.6 |
| Examples | 10 | [0] | [0] | 0.015 | [0.0157] | 25.3 | 35.8 | 13.5 | 16.7 | 8.7 | [0.7] |
| | 11 | 0.0075 | [0.0125] | 0.013 | 0.0002 | 78.9 | 3.5 | 6.5 | 4.3 | 6.8 | [22.5] |
| | 12 | 0.0002 | [0] | 0.012 | 0.0087 | 42.8 | 22.8 | 10.5 | 17.9 | 6.0 | 1.9 |
| | 13 | [0.0151] | [0.0123] | 0.018 | [0.00005] | 76.3 | 6.3 | 6.5 | 3.8 | 7.1 | [12.1] |

TABLE 2

| | | Number of oxide type inclusions (number/$cm^2$) | | Oxide type non-metallic inclusions composition (mass %) 20 points analyzed by EDS | | | | | | | | |
|---|---|---|---|---|---|---|---|---|---|---|---|---|
| | | | | Magnesia | | Spinel type | | | $CaO—Al_2O_3—MgO$ type | | | |
| | No. | 5 μm or more | 100 μm or more | n | MgO | n | MgO | $Al_2O_3$ | n | CaO | $Al_2O_3$ | MgO |
| Examples | 1 | 12 | 0 | 13 | 100 | 0 | | | 7 | 64.3 | 8.1 | 27.6 |
| | 2 | 38 | 0 | 6 | 100 | 0 | | | 14 | 42.1 | 55.2 | 2.7 |
| | 3 | 25 | 0 | 5 | 100 | 0 | | | 15 | 50.3 | 25.2 | 24.5 |
| | 4 | 28 | 0 | 0 | | 0 | | | 20 | 58.7 | 15.2 | 26.1 |
| | 5 | 45 | 1 | 0 | | 3 | 25.3 | 74.7 | 17 | 30.2 | 45.3 | 18.2 |
| | 6 | 48 | 0 | 0 | | 7 | 24.5 | 75.5 | 13 | 31.5 | 55.6 | 12.9 |
| | 7 | 43 | 1 | 5 | 100 | 9 | 25.6 | 74.4 | 6 | 30.9 | 54.3 | 8.1 |
| | 8 | 36 | 0 | 12 | 100 | 8 | 29.5 | 70.5 | 0 | | | |
| Comparative | 9 | 25 | 0 | 5 | 100 | 0 | | | 15 | 50.3 | 25.2 | 24.5 |
| Examples | 10 | [152] | [12] | 0 | | 0 | | | [7] | [0] | [68.8] | [0] |
| | 11 | 25 | [5] | 0 | | 0 | | | [13] | [71.2] | [1.2] | [15.3] |
| | 12 | [102] | [7] | 2 | 100 | [13] | [25.6] | [74.4] | [5] | [0] | [60.3] | [10.1] |
| | 13 | 34 | [5] | 1 | 100 | 0 | | | [9] | [75.3] | [3.5] | [6.0] |

| | | Oxide type non-metallic inclusions composition (mass %) 20 points analyzed by EDS | | | | | | | Quality evaluation (number/coil) | |
|---|---|---|---|---|---|---|---|---|---|---|
| | | $CaO—Al_2O_3—MgO$ type | | CaO | | Alumina | | Spinel ratio | Defects by TiN | Defects by oxide inclusions |
| | No. | $SiO_2$ | $TiO_2$ | n | CaO | n | $Al_2O_3$ | % | | |
| Examples | 1 | 0 | 0 | 0 | | 0 | | 0 | 0 | 0 |
| | 2 | 0 | 0 | 0 | | 0 | | 0 | 0 | 0 |
| | 3 | 0 | 0 | 0 | | 0 | | 0 | 0 | 0 |
| | 4 | 0 | 0 | 0 | | 0 | | 0 | 0 | 0 |
| | 5 | 1.1 | 5.2 | 0 | | 0 | | 15 | 0 | 5 |
| | 6 | 0 | 0 | 0 | | 0 | | 35 | 0 | 4 |
| | 7 | 6.7 | 0 | 0 | | 0 | | 45 | 0 | 8 |
| | 8 | | | 0 | | 0 | | 40 | 0 | 7 |
| Comparative | 9 | 0 | 0 | 0 | | 0 | | 0 | 251 | 0 |
| Examples | 10 | [10.8] | [20.4] | 0 | | [13] | [100] | 0 | 0 | 567 |
| | 11 | [0] | [12.3] | [7] | [100] | 0 | | 0 | 15 | 284 |
| | 12 | [19.3] | [10.3] | 0 | | 0 | | [65] | 0 | 189 |
| | 13 | [0] | [15.2] | [10] | [100] | 0 | | 0 | 13 | 432 |

The chemical composition, slag composition, number of non-metallic inclusions, condition of inclusions, and surface defects of coils shown in Tables 1 and 2 are evaluated as follows.

1) Chemical composition of alloy and slag composition: Quantitative analysis was performed by using an X-ray fluorescent spectrometer. Quantitative analysis of oxygen and nitrogen concentration of alloy was performed by an inert gas impulse melting IR absorption method.

2) Number of inclusions of 5 μm or more: Sample (diameter: 35 mm×thickness 15 mm) was collected in a tundish of a continuous casting apparatus, the sample was cut, mirror polishing was performed, and number of inclusions was counted at a freely selected cross section. It should be noted that the number of oxide type inclusions was counted here.

3) Non-metallic inclusion composition: The above sample, which was used to count the number of inclusions, was used and analyzed. By using SEM-EDS, 20 pieces of oxide type inclusions having a size 5 μm or more were measured at random.

4) Number ratio of spinel inclusions: The number ratio was calculated from the measured result of the above 3).

5) Quality evaluation: Surface of the cold rolled plate produced by rolling was visually observed, and the number of defects occurred by TiN and defects occurred by oxide type inclusions were counted. The defects by TiN were observed to be stringy and the defects by oxide type inclusions were observed to be linear, and they were separated and counted.

Examples and Comparative Examples shown in Table 1 were explained. Here, Example 6 was produced by using VOD as a refining furnace, Example 8 was produced by combining AOD and VOD. The other Examples were produced by using AOD in refining.

In Examples 1 to 8, since they satisfy the range of the present invention, the number of oxide type inclusions of 5 μm or more was 50/cm$^2$ or less, number of oxide type inclusions of 100 μm or more was 5/cm$^2$ or less, and there was no or almost no (8 or less) defects on the surface of final product, which was of superior quality. It should be noted that if the number of oxide type inclusions of 100 μm or more is 5/cm$^2$ or less, it can be sufficiently used as a product. The reason for generating 1/cm$^2$ inclusions in Examples 5 and 8 is that $SiO_2$ and $TiO_2$ were contained in the allowable range of the present invention. Furthermore, if the number of defects is 8 or less, it can be sufficiently used as a product. The reason for generating a few defects in Examples 5 and 8 is that spinel inclusions were generated at 50% or less.

On the other hand, since Comparative Examples were out of the range of the present invention, surface defects were generated. Hereinafter, each Comparative Examples is explained.

Si concentration was 0.68% and N concentration was 0.025% which are high values in Comparative Example 9, and many defects were caused by TiN.

Si concentration, Mo concentration, and Al concentration were low and slag basicity C/S was 0.7, which was a low value in Comparative Example 10, deoxidizing by Si and Al was insufficient, and oxygen concentration was 0.0157%, which is a high value. As a result, the number of the inclusions of 5 μm or more was 152/cm$^2$ and the number of the inclusions of 100 μm or more was 12/cm$^2$ which are high values, and compositions mainly contained alumina. As a result, many defects caused by oxide type inclusions were generated.

Si concentration and Al concentration were high and slag basicity C/S was 22.5 which was a high value in Comparative Example 11, deoxidizing reaction was strong, and Ca concentration was increased. Therefore, composition of CaO—$Al_2O_3$—MgO type inclusions was out of the range, inclusions mainly contained CaO, and defects caused by oxide inclusions were numerous. In addition, since the Ti concentration was also high, defects caused by TiN were also generated.

Si concentration and Al concentration were low, deoxidizing was insufficient and Ca concentration was 0 in Comparative Example 12. Since deoxidizing was insufficient, not only was the number of inclusions of 5 μm or more was 102/cm$^2$ and the number of the inclusions of 100 μm or more was 7/cm$^2$, which are high values, but also the number ratio of spinel inclusions was 65%, which is a high value, and numerous defects caused by oxide type inclusions were generated.

Si concentration, Mn concentration and Al concentration were high and slag basicity C/S was 12.1 which is a high value in Comparative Example 13, deoxidizing reaction was strong, and O concentration was decreased to outside of the range. In addition, Mg and Ca concentrations were high. Therefore, composition of CaO—$Al_2O_3$—MgO type inclusions was out of the range, CaO inclusions were also generated, and numerous defects caused by oxide inclusions were generated. In addition, since Si concentration was also high, which was out of the range, activity of Ti was increased and defects caused by TiN was also generated.

According to the present invention, high quality Fe—Cr—Ni—Mo alloy for sheathed heater can be produced at low cost.

What is claimed is:

1. An Fe—Cr—Ni—Mo alloy comprising, % indicating mass %:

C: 0.03% or less, Si: 0.15 to 0.5%, Mn: 0.1 to 1%, P: 0.03% or less, S: 0.002% or less, Ni: 21 to 29%, Cr: 20 to 26%, Mo: 0.5 to 2.5%, Al: 0.1 to 0.5%, Ti: 0.1 to 0.5%, Mg: 0.0002 to 0.01%, Ca: 0.0002 to 0.01%, N: 0.02% or less, O: 0.0001 to 0.01%, Co: 0.05 to 2% and Cu: 0.01 to 0.5% as freely contained components, Fe as a remainder, and inevitable impurities, wherein MgO, MgO.$Al_2O_3$ spinel, and CaO—$Al_2O_3$—MgO are contained as oxide non-metallic inclusions, ratio of number of the MgO.$Al_2O_3$ spinel to all oxide non-metallic inclusions is 50% or less, and the CaO—$Al_2O_3$—MgO comprises CaO: 30 to 70%, $Al_2O_3$: 5 to 60%, MgO: 1 to 30%, $SiO_2$: 8% or less, and $TiO_2$: 10% or less.

2. The Fe—Cr—Ni—Mo alloy according to claim 1, wherein as oxide non-metallic inclusions, composition range of the MgO.$Al_2O_3$ spinel is MgO: 15 to 35% and $Al_2O_3$: 65 to 85%.

3. The Fe—Cr—Ni—Mo alloy according to claim 1, wherein the number of oxide non-metallic inclusions of 5 μm or more is 50/cm$^2$ or less and the number of oxide non-metallic inclusions of 100 μm or more is 5/cm$^2$ or less, in the case in which the number of the inclusions is measured at a freely selected cross section of a sample collected in a tundish of a continuous casting apparatus.

4. The Fe—Cr—Ni—Mo alloy according to claim 1, wherein the number of oxide non-metallic inclusions of 5 μm or more is 48/cm$^2$ or less and the number of oxide non-metallic inclusions of 100 μm or more is 3/cm$^2$ or less in the case in which the number of the inclusions is measured at a freely selected cross section of a sample collected in a tundish of a continuous casting apparatus.

5. The Fe—Cr—Ni—Mo alloy according to claim 1, wherein $SiO_2$ and $TiO_2$ contained in the CaO—$Al_2O_3$—MgO as oxide non-metallic inclusions is 2 mass % or less and 6 mass % or less, respectively.

6. The Fe—Cr—Ni—Mo alloy according to claim 1, wherein no $SiO_2$ and $TiO_2$ are contained in the CaO—$Al_2O_3$—MgO as oxide non-metallic inclusions.

7. The Fe—Cr—Ni—Mo alloy according to claim 2, wherein the number of oxide non-metallic inclusions of 5 μm or more is 50/cm$^2$ or less and the number of oxide type non-metallic inclusions of 100 μm or more is 5/cm$^2$ or less, in the case in which the number of inclusions is measured at a freely selected cross section of a sample collected in a tundish of a continuous casting apparatus.

8. The Fe—Cr—Ni—Mo alloy according to claim 2, wherein the number of oxide non-metallic inclusions of 5 μm or more is 48/cm$^2$ or less and the number of oxide non-metallic inclusions of 100 μm or more is 3/cm$^2$ or less in the case in which the number of the inclusions is measured at a freely selected cross section of a sample collected in a tundish of a continuous casting apparatus.

9. The Fe—Cr—Ni—Mo alloy according to claim 2, wherein $SiO_2$ and $TiO_2$ contained in the CaO—$Al_2O_3$—MgO as oxide non-metallic inclusions is 2 mass % or less and 6 mass % or less, respectively.

10. The Fe—Cr—Ni—Mo alloy according to claim 3, wherein $SiO_2$ and $TiO_2$ contained in the CaO—$Al_2O_3$—MgO as oxide non-metallic inclusions is 2 mass % or less and 6 mass % or less, respectively.

11. The Fe—Cr—Ni—Mo alloy according to claim 7, wherein $SiO_2$ and $TiO_2$ contained in the CaO—$Al_2O_3$—MgO as oxide non-metallic inclusions is 2 mass % or less and 6 mass % or less, respectively.

12. The Fe—Cr—Ni—Mo alloy according to claim 4, wherein $SiO_2$ and $TiO_2$ contained in the CaO—$Al_2O_3$—MgO as oxide non-metallic inclusions is 2 mass % or less and 6 mass % or less, respectively.

13. The Fe—Cr—Ni—Mo alloy according to claim 8, wherein $SiO_2$ and $TiO_2$ contained in the CaO—$Al_2O_3$—MgO as oxide non-metallic inclusions is 2 mass % or less and 6 mass % or less, respectively.

14. The Fe—Cr—Ni—Mo alloy according to claim 2, wherein no $SiO_2$ and $TiO_2$ are contained in the CaO—$Al_2O_3$—MgO as oxide non-metallic inclusions.

15. The Fe—Cr—Ni—Mo alloy according to claim 3, wherein no $SiO_2$ and $TiO_2$ are contained in the CaO—$Al_2O_3$—MgO as oxide non-metallic inclusions.

16. The Fe—Cr—Ni—Mo alloy according to claim 7, wherein no $SiO_2$ and $TiO_2$ are contained in the CaO—$Al_2O_3$—MgO as oxide non-metallic inclusions.

17. The Fe—Cr—Ni—Mo alloy according to claim 4, wherein no $SiO_2$ and $TiO_2$ are contained in the CaO—$Al_2O_3$—MgO as oxide non-metallic inclusions.

18. The Fe—Cr—Ni—Mo alloy according to claim 8, wherein no $SiO_2$ and $TiO_2$ are contained in the CaO—$Al_2O_3$—MgO as oxide non-metallic inclusions.

19. A method for production of the Fe—Cr—Ni—Mo alloy according to claim 1, comprising:

melting raw materials so as to melt Fe—Cr—Ni—Mo alloy containing Ni: 21 to 29%, Cr: 20 to 26%, Mo: 0.5 to 2.5%, decarburizing in AOD and/or VOD, adding lime, fluorite, ferrosilicon alloy, and Al so as to form CaO—$SiO_2$—$Al_2O_3$—MgO—F slag having CaO/$SiO_2$ 1.5 to less than 4, and preparing Fe—Cr—Ni—Mo melt alloy comprising C: 0.03% or less, Si: 0.15 to 0.5%, Mn: 0.1 to 1%, P: 0.03% or less, S: 0.002% or less, Al: 0.1 to 0.5%, Ti: 0.1 to 0.5%, Mg: 0.0002 to 0.01%, Ca: 0.0002 to 0.01%, N: 0.02% or less, O: 0.0001 to 0.01%, freely contained components of Co: 0.05 to 2% and Cu: 0.01 to 0.5%, Fe as a remainder, and inevitable impurities.

* * * * *